US009375932B2

(12) United States Patent
Nawano et al.

(10) Patent No.: US 9,375,932 B2
(45) Date of Patent: Jun. 28, 2016

(54) LIQUID EJECTING APPARATUS

(71) Applicant: SEIKO EPSON CORPORATION, Tokyo (JP)

(72) Inventors: Masahisa Nawano, Suwa (JP); Masaru Kobashi, Matsumoto (JP); Masaru Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/944,511

(22) Filed: Nov. 18, 2015

(65) Prior Publication Data

US 2016/0152030 A1 Jun. 2, 2016

(30) Foreign Application Priority Data

Nov. 28, 2014 (JP) ..... 2014-241804

(51) Int. Cl.
*B41J 2/165* (2006.01)

(52) U.S. Cl.
CPC ..... *B41J 2/16523* (2013.01); *B41J 2/16505* (2013.01); *B41J 2/16526* (2013.01); *B41J 2/16535* (2013.01)

(58) Field of Classification Search
CPC ..... B41J 2/16523; B41J 2/16526; B41J 2/16535; B41J 2/16505; B41J 2/16517
See application file for complete search history.

(56) References Cited

U.S. PATENT DOCUMENTS 7,357,498 B2 * 4/2008 Tsukahara ..... B41J 2/175 347/85
2013/0135385 A1 5/2013 Kanzaki

FOREIGN PATENT DOCUMENTS

JP 2002-127468 A 5/2002
JP 2012-086368 A 5/2012
JP 2013-111898 A 6/2013

* cited by examiner

*Primary Examiner* — Juanita D Jackson
(74) *Attorney, Agent, or Firm* — Workman Nydegger

(57) ABSTRACT

A liquid ejecting apparatus performs a wiping process for wiping a nozzle forming face while a leaking process for leaking liquid from a plurality of nozzle groups is performed by setting a pressure difference to a second pressure difference which is smaller than a first pressure difference, after performing a discharging process for discharging liquid from a part of nozzle groups among the plurality of nozzle groups by setting the pressure difference to the first pressure difference, when a difference which is obtained by subtracting an external pressure which is a pressure in a space to which a nozzle is open from an internal pressure which is a pressure of liquid in the nozzle included in the plurality of nozzle groups which eject liquid is set to the pressure difference.

6 Claims, 6 Drawing Sheets

LIQUID EJECTING APPARATUS

BACKGROUND

1. Technical Field

The present invention relates to a liquid ejecting apparatus such as an ink jet printer.

2. Related Art

In the related art, as an example of a liquid ejecting apparatus, an ink jet printer which performs printing by ejecting ink as an example of liquid onto a medium such as a sheet from nozzles which are formed in a liquid ejecting head has been known.

In such a printer, there is a printer in which maintenance of a liquid ejecting head such as cleaning in which ink is discharged from the liquid ejecting head independently of printing, or wiping in which a nozzle forming face of the liquid ejecting head is wiped using a wiper is performed, in order to maintain good ejecting properties of ink in nozzles of the liquid ejecting head.

For example, in JP-A-2012-86368, a printer is disclosed in which the amount of ink consumption which is accompanied by the execution of cleaning is reduced by performing selective cleaning on only a nozzle group of which ink ejecting properties deteriorate, with respect to a liquid ejecting head in which a first nozzle group which includes a plurality of nozzles which eject black ink, and a second nozzle group which includes a plurality of nozzles which eject color ink are formed.

In addition, in the printer, when cleaning is executed with respect to a part of the nozzle groups, wiping of the nozzle forming face is performed from a nozzle group side on which cleaning is executed toward a nozzle group side on which cleaning is not executed. In this manner, ink which is attached onto the nozzle forming face is removed by executing the cleaning, and it is possible to suppress erroneous wiping by not wiping a dried nozzle forming face using a dried wiper.

Meanwhile, in the above described printer, when ink is not ejected, the pressure of ink in a nozzle is maintained to be a negative pressure so that ink does not flow out from the nozzle of the liquid ejecting head. For this reason, even when wiping after cleaning is executed from a nozzle group in which cleaning is executed toward a nozzle group in which cleaning is not executed, there is a concern that erroneous wiping may occur, when a wiper presses bubbles into the nozzle. In this case, ejecting properties of ink in the nozzle in which bubbles are mixed deteriorate.

SUMMARY

An advantage of some aspects of the invention is to provide a liquid ejecting apparatus in which mixing of bubbles in nozzles can be suppressed, when wiping a nozzle forming face on which a plurality of nozzle groups are formed, after liquid is discharged from a nozzle which is included in a part of the nozzle groups among the plurality of nozzle groups.

Hereinafter, means and operation effects thereof will be described.

According to an aspect of the invention, there is provided a liquid ejecting apparatus which includes a liquid ejecting unit which includes a nozzle forming face on which a plurality of nozzle groups for ejecting liquid are formed; a pressure difference causing unit which causes a pressure difference so that the internal pressure is higher than the external pressure in nozzles included in one or more nozzle groups among the plurality of nozzle groups, when the difference which is obtained by subtracting the external pressure which is the pressure in a space to which a nozzle is open from the internal pressure which is the pressure of liquid in the nozzle included in the nozzle groups is set to be the pressure difference; and a wiping unit which wipes the nozzle forming face, in which a wiping process for wiping the nozzle forming face is performed while a leaking process for leaking liquid from the plurality of nozzle groups is performed by setting the pressure difference to be a second pressure difference which is smaller than the first pressure difference, after performing a discharging process for discharging liquid from a part of nozzle groups among the plurality of nozzle groups by setting the pressure difference to be the first pressure difference.

According to the configuration, for example, the discharging process for discharging liquid from a part of nozzle groups in which an ejecting failure of liquid occurs is performed, by causing a pressure difference between the pressure (internal pressure) of liquid in nozzles which are included in the part of nozzle groups among the plurality of nozzle groups and the pressure (external pressure) in a space to which the nozzle is open.

Subsequently, a leaking process for leaking liquid from the plurality of nozzle groups is performed by causing a pressure difference (second pressure difference) which is smaller than the pressure difference (first pressure difference) in the discharging process, in nozzles which are included in a plurality of nozzle groups including a part of the nozzle groups in which the discharging process is performed, and other nozzle groups in which the discharging process is not performed.

In addition, in a state in which the leaking process is performed, a wiping process for wiping a nozzle forming face on which the plurality of nozzle groups are formed is performed. Here, in the wiping process, it is possible to prevent the wiping unit from pushing bubbles into nozzles, since the pressure (internal pressure) of liquid in the nozzles which are included in the plurality of nozzle groups is higher than the pressure (external pressure) in a space to which the nozzle is open.

In this manner, it is possible to suppress mixing of bubbles into the nozzles which are included in the plurality of nozzle groups when wiping the nozzle forming face on which the plurality of nozzle groups are formed, after discharging liquid from the nozzles which are included in a part of the nozzle groups among the plurality of nozzle groups.

It is preferable for the liquid ejecting apparatus to further include a cap which forms a closed space which includes an opening of the nozzle in each of the nozzle groups by coming into contact with the nozzle forming face.

According to the configuration, it is possible to form a closed space using the cap with respect to one of a nozzle group which is a target of the discharging process and a nozzle group which is not a target of the discharging process. Accordingly, it is possible to prevent liquid discharged from the nozzle group which is the target of the discharging process from coming into the nozzle which is not included in the nozzle group which is not the target of the discharging process through the nozzle forming face, or the like. In particular, when a closed space is formed in the nozzle group which is the target of the discharging process, using a cap, it is possible to prevent scattering of liquid discharged from the nozzle by executing the discharging process.

In the liquid ejecting apparatus, it is preferable that the pressure difference causing unit includes a suctioning mechanism which suctions liquid from the closed space, and the discharging process is performed when the suctioning mechanism suctions liquid from the closed space, and lowers the external pressure.

According to the configuration, the pressure (external pressure) in the space to which a nozzle is open is the same as the pressure in the closed space, since the closed space is formed using a cap. For this reason, when the closed space is decompressed by suctioning fluid from the closed space, the external pressure is lowered. That is, it is possible to perform the discharging process for discharging liquid from a nozzle which is open to a closed space, by causing a pressure difference between internal pressure and external pressure by lowering the external pressure.

In addition, according to the discharging process (suctioning cleaning) which is performed by lowering the external pressure, it is possible to easily discharge liquid from one or more nozzle groups which are selected from the plurality of nozzle groups, regardless of a supply form of liquid with respect to the plurality of nozzle groups compared to a discharging process (pressurizing cleaning) which is performed by increasing the internal pressure by pressurizing liquid which is supplied to the liquid ejecting unit.

It is preferable that the liquid ejecting apparatus further includes a supply flow path through which liquid accommodated in a liquid accommodation unit is supplied to the liquid ejecting unit, the pressure difference causing unit includes a liquid chamber which is provided in the middle of the supply flow path, and a volume changing unit which changes the volume of the liquid chamber, the volume changing unit makes the volume of the liquid chamber small, and the leaking process is performed by raising the internal pressure.

According to the configuration, it is possible to raise the pressure (internal pressure) of liquid in the nozzle of the liquid ejecting unit which communicates with the liquid chamber through the supply flow path, by making the volume of the liquid chamber which is provided in the middle of the supply flow path small. In addition, it is possible to leak liquid from the nozzles which are included in the plurality of nozzle groups by causing a pressure difference between the internal pressure and the external pressure, by increasing the internal pressure.

In the liquid ejecting apparatus, it is preferable that the pressure difference causing unit includes a pressurizing supply unit which supplies liquid to the liquid ejecting unit in a pressurized manner, the pressurizing supply unit supplies liquid in the pressurized manner, and at least one of the discharging process and the leaking process is performed by raising the internal pressure.

According to the configuration, it is possible to perform the discharging process or the leaking process by causing a pressure difference between the internal pressure and the external pressure, by increasing the internal pressure using a pressurized supply of the pressurizing supply unit. For this reason, when a configuration for supplying liquid which is accommodated in the liquid accommodation unit to the liquid ejecting unit is provided in the liquid ejecting apparatus, it is not necessary to provide an additional configuration (for example, cap) for performing the discharging process or the leaking process.

It is preferable that the liquid ejecting apparatus further includes a detection unit which can detect a defective nozzle in which an ejecting failure of liquid occurs, and the discharging process is performed with respect to the nozzle group which includes the defective nozzle which is detected by the detection unit.

According to the configuration, it is possible to selectively perform the discharging process with respect to the nozzle group including the nozzle in which an ejecting failure of liquid occurs. Accordingly, it is possible to suppress performing of a discharging process with respect to the nozzle group which does not include a nozzle in which an ejecting failure of liquid occurs, and to suppress an increase in the amount of liquid consumption which is caused by an unnecessary discharging process.

BRIEF DESCRIPTION OF THE DRAWINGS

The invention will be described with reference to the accompanying drawings, wherein like numbers reference like elements.

FIGS. 5A and 5B are diagrams which illustrate schematic configurations of the liquid ejecting apparatus when performing pressurizing wiping, in which FIG. 5A illustrates the entire configuration, and FIG. 5B illustrates the vicinity of a nozzle.

DESCRIPTION OF EXEMPLARY EMBODIMENTS

Hereinafter, an embodiment of a liquid ejecting apparatus will be described with reference to drawings. In addition, the liquid ejecting apparatus is, for example, an ink jet printer which performs printing on a medium by ejecting ink as an example of liquid onto the medium such as a sheet.

Figure 1:
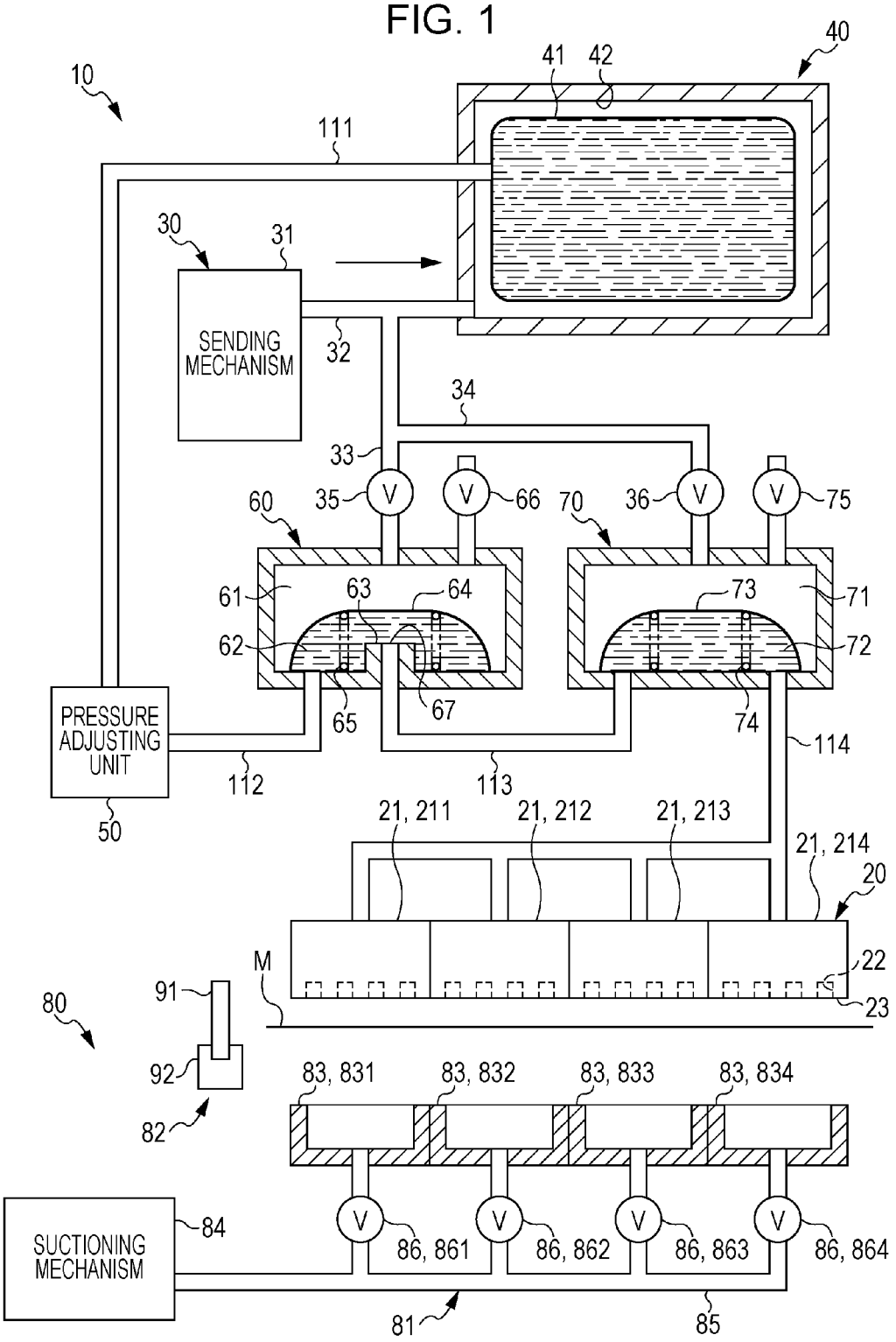
FIG. 1 is a diagram which illustrates a schematic configuration of a liquid ejecting apparatus according to an embodiment.

As illustrated in FIG. 1, a liquid ejecting apparatus 10 includes a liquid ejecting unit 20 which ejects liquid, a sending unit 30 which sends out gas (air), a liquid accommodation unit 40 which accommodates liquid to be supplied to the liquid ejecting unit 20, and a pressure adjusting unit 50 which adjusts a pressure of liquid to be supplied to the liquid ejecting unit 20 from the liquid accommodation unit 40. In addition, the liquid ejecting apparatus 10 further includes a supply regulation unit 60 which can regulate a supply of liquid from the liquid accommodation unit 40 to the liquid ejecting unit 20, a liquid pressurizing unit 70 which can pressurize a pressure of liquid to be supplied to the liquid ejecting unit 20, and a maintenance device 80 which performs maintenance of the liquid ejecting unit 20.

In addition, the liquid ejecting apparatus 10 further includes a first supply flow path 111 which connects the liquid accommodation unit 40 and the pressure adjusting unit 50, and a second supply flow path 112 which connects the pressure adjusting unit 50 and the supply regulation unit 60 as an example of a "supply flow path" through which liquid accommodated in the liquid accommodation unit 40 is supplied to the liquid ejecting unit 20. In addition, the liquid ejecting apparatus 10 further includes a third supply flow path 113 which connects the supply regulation unit 60 and the liquid pressurizing unit 70, and a fourth supply flow path 114 which connects the liquid pressurizing unit 70 and the liquid ejecting unit 20 as an example of the "supply flow path". In addition, in the following descriptions, the upstream and the downstream will be referred to along a circulation direction of gas and air.

As illustrated in FIG. 1, the liquid ejecting unit 20 includes a plurality of liquid ejecting heads 21 (four, in the embodiment). Nozzle forming faces 23 on which a plurality of nozzles 22 are formed are formed in each of the liquid ejecting heads 21. In addition, the fourth supply flow path 114 is connected to the plurality of liquid ejecting heads 21 by being branched.

In addition, the liquid ejecting unit 20 ejects liquid toward a medium M from the plurality of nozzles 22 of the plurality of liquid ejecting heads 21. For example, for every nozzles 22 of the liquid ejecting heads 21, the liquid ejecting unit 20 includes a liquid chamber which stores liquid, a vibrating plate which forms a part of the liquid chamber, and a piezoelectric element which is attached to the vibrating plate, and ejects liquid from the nozzles 22 by changing a volume of the liquid chamber, by vibrating the vibrating plate due to driving of the piezoelectric element. Here, in a printer as an example of the liquid ejecting apparatus 10, characters or an image is printed on a sheet when ink is ejected onto the sheet as an example of the medium M.

In addition, in the following descriptions, the plurality of liquid ejecting heads 21 are also referred to as a first head 211, a second head 212, a third head 213, and a fourth head 214, and an arbitrary liquid ejecting head is also referred to as an "Nth head". In addition, according to the embodiment, the plurality of nozzles 22 which are formed in the respective liquid ejecting heads 21 correspond to an example of the "nozzle group".

In addition, in FIG. 1, for ease of descriptions, it is assumed that all of neighboring nozzles 22 are arranged at regular intervals when the liquid ejecting unit 20 is viewed from a transport direction of the medium M (direction orthogonal to paper plane in FIG. 1) in practice, though an interval between nozzles 22 neighboring in the same liquid ejecting head 21, and an interval between nozzles 22 which are neighboring by straddling the liquid ejecting head 21 are different.

As illustrated in FIG. 1, the sending unit 30 includes a sending mechanism 31 which sends out gas by pressurizing the gas, a first sending flow path 32 which connects the sending unit 30 and the liquid accommodation unit 40, a second sending flow path 33 which connects the first sending flow path 32 and the supply regulation unit 60, and a third sending flow path 34 which connects the second sending flow path 33 and the liquid pressurizing unit 70. The sending mechanism 31 may be a pump such as a compressor, for example. The first sending flow path 32 and the second sending flow path 33 are flow paths which can circulate gas.

In addition, the sending unit 30 includes a first sending valve 35 which can regulate a circulation of gas with respect to the supply regulation unit 60 through the second sending flow path 33, and a second sending valve 36 which can regulate a circulation of gas with respect to the liquid pressurizing unit 70 through the third sending flow path 34. Specifically, the first sending valve 35 allows a circulation of gas from the sending mechanism 31 to the supply regulation unit 60 when the valve is open, and on the other hand, regulates a circulation of gas from the sending mechanism 31 to the supply regulation unit 60 when the valve is closed. In addition, the second sending valve 36 allows a circulation of gas from the sending mechanism 31 to liquid pressurizing unit 70 when the valve is open, and on the other hand, regulates a circulation of gas from the sending mechanism 31 to liquid pressurizing unit 70 when the valve is closed.

In addition, the sending unit 30 sends out gas to the liquid accommodation unit 40 through the first sending flow path 32. In addition, the sending unit 30 sends out gas to the supply regulation unit 60 and the liquid pressurizing unit 70 through the second sending flow path 33 and the third sending flow path 34 according to opening-closing states of the first sending valve 35 and the second sending valve 36.

As illustrated in FIG. 1, the liquid accommodation unit 40 includes a liquid accommodation body 41 which is compressively deformed according to an external force. The liquid accommodation body 41 forms a bag shape which is formed of a flexible film member, and communicates with an upstream end of the first supply flow path 111. In addition, a storage chamber 42 which stores the liquid accommodation body 41 is formed in the liquid accommodation unit 40. The storage chamber 42 is set to a closed system to which a downstream end of the first sending flow path 32 is connected, and a pressure thereof increases when gas flows in through the first sending flow path 32. In addition, the liquid accommodation unit 40 supplies liquid which is accommodated in the liquid accommodation body 41 toward the downstream side by causing the liquid accommodation body 41 to be compressively deformed using an increase in pressure of the storage chamber 42 which is accompanied by flow-in of gas to the storage chamber 42.

The pressure adjusting unit 50 causes the first supply flow path 111 and the second supply flow path 112 to communicate, when a pressure of liquid in the second supply flow path 112 which communicates with the liquid ejecting unit 20 becomes less than a predetermined pressure which is smaller than an atmospheric pressure by causing liquid to be ejected from the liquid ejecting unit 20. Meanwhile, the pressure adjusting unit 50 causes the first supply flow path 111 and the second supply flow path 112 not to communicate, when a pressure of liquid in the second supply flow path 112 becomes less than a predetermined pressure by causing the first supply flow path 111 and the second supply flow path 112 to communicate.

In this manner, the pressure adjusting unit 50 adjusts a pressure of liquid which is supplied to the liquid ejecting unit 20 so as to be a pressure equal to or smaller than a predetermined pressure. In addition, in this point, according to the embodiment, a pressure of liquid on the upstream side of the pressure adjusting unit 50 is set to a pressure equal to or greater than an atmospheric pressure (approximately 20 Pa, for example), and a pressure of liquid on the downstream side of the pressure adjusting unit 50 is set to a pressure less than the atmospheric pressure (approximately −1 kPa, for example).

As illustrated in FIG. 1, a gas chamber 61 which can store gas, a liquid chamber 62 which can store liquid, and a protrusion unit 63 which is formed in a protruding manner in a direction which goes from the liquid chamber 62 toward the gas chamber 61 in the liquid chamber 62 are formed in the supply regulation unit 60. The supply regulation unit 60 further includes a film member 64 which partitions the gas chamber 61 and the liquid chamber 62, an urging member 65 which urges the film member 64 in a direction in which a volume of the liquid chamber 62 increases in the liquid chamber 62, and a first opening valve 66 which opens the liquid chamber 62 to the atmosphere.

The gas chamber 61 communicates with a downstream end of the second sending flow path 33, and the liquid chamber 62 communicates with a downstream end of the second supply flow path 112, and an upstream end of the third supply flow path 113. Here, the upstream end of the third supply flow path 113 communicates with the liquid chamber 62 through an opening 67 of the protrusion unit 63.

The film member 64 is flexible, and is displaced in a direction in which volumes of the gas chamber 61 and the liquid chamber 62 are increased according to a pressure difference between the gas chamber 61 and the liquid chamber 62. In addition, the film member 64 can close the opening 67 of the protrusion unit 63. In addition, the first opening valve 66 causes the gas chamber 61 and atmospheric air to communicate when the valve is open, and on the other hand, causes the gas chamber 61 and atmospheric air not to communicate when the valve is closed.

In addition, in the following descriptions, an arrangement of the film member 64 of the supply regulation unit 60 in FIG. 1 is also referred to as an "allowing position". A state of the supply regulation unit 60 when the film member 64 is located at the allowing position is also referred to as an "allowing state". Here, when the supply regulation unit 60 is in the allowing state, a supply of liquid from the second supply flow path 112 to the third supply flow path 113 is allowed.

As illustrated in FIG. 1, a gas chamber 71 which can store gas, and a liquid chamber 72 which can store liquid are formed in the liquid pressurizing unit 70. The liquid pressurizing unit 70 includes a film member 73 which partitions the gas chamber 71 and the liquid chamber 72, an urging member 74 which urges the film member 73 in a direction in which a volume of the liquid chamber 72 is increased in the liquid chamber 72, and a second opening valve 75 which causes the liquid chamber 72 to open to atmospheric air.

The gas chamber 71 communicates with a downstream end of the third sending flow path 34, and the liquid chamber 72 communicates with a downstream end of the third supply flow path 113 and an upstream end of the fourth supply flow path 114. In addition, the film member 73 is displaced in a direction in which volumes of the gas chamber 71 and the liquid chamber 72 are increased according to a pressure difference between the gas chamber 71 and the liquid chamber 72. In addition, the second opening valve 75 causes the gas chamber 71 and atmospheric air to communicate when the valve is open, and on the other hand, causes the gas chamber 71 and atmospheric air not to communicate when the valve is closed.

In addition, in the following descriptions, an arrangement of the film member 73 of the liquid pressurizing unit 70 in FIG. 1 is also referred to as a "non-pressurizing position", and a state of the liquid pressurizing unit 70 when the film member 73 is located at the non-pressurizing position is also referred to as a "non-pressurizing state". Here, the liquid pressurizing unit 70 in the non-pressurizing state does not pressurize liquid in the inside of the liquid ejecting head 21.

As illustrated in FIG. 1, the maintenance device 80 includes a cleaning device 81 which performs cleaning for discharging liquid from the nozzle 22 of the liquid ejecting head 21, and a wiping device 82 which performs wiping for wiping the nozzle forming face 23 of the liquid ejecting head 21.

The cleaning device 81 includes a cap 83 which forms a bottomed box shape, a suctioning mechanism 84 which suctions the inside of the cap 83, a suctioning flow path 85 which connects the cap 83 and the suctioning mechanism 84, a suctioning valve 86 which is provided in the suctioning flow path 85, and an elevating mechanism 87 (refer to FIG. 2) which causes the cap 83 to go up and down.

A plurality of the caps 83 and suctioning valves 86 are provided so as to correspond to the plurality of liquid ejecting heads 21. The suctioning flow path 85 is connected to the plurality of cap 83 by being branched, and suctioning valves 86 are respectively provided at portions of the branched flow path of the suctioning flow path 85. The suctioning valve 86 allows a circulation of liquid in the suctioning flow path 85 when the valve is open, and on the other hand, regulates a circulation of liquid in the suctioning flow path 85 when the valve is closed.

In addition, the cap 83 forms the closed space CS (refer to FIG. 4) which includes an opening of the nozzle 22 of the liquid ejecting head 21 in each liquid ejecting head 21, by coming into contact with the liquid ejecting head 21. In addition, the suctioning mechanism 84 suctions a fluid (gas or liquid) from the closed space CS when being driven in a state in which the closed space CS is formed by the cap 83.

In addition, in the following descriptions, the plurality of cap 83 are also referred to as a first cap 831, a second cap 832, a third cap 833, and a fourth cap 834, and an arbitrary cap is also referred to as an "Nth cap". In addition, the plurality of suctioning valves 86 are also referred to as a first suctioning valve 861, a second suctioning valve 862, a third suctioning valve 863, and a fourth suctioning valve 864, and an arbitrary suctioning valve is also referred to as an "Nth suctioning valve". As an example, the first cap 831 and the first suctioning valve 861 correspond to the first head 211.

The wiping device 82 includes a wiper 91 which has elasticity, a wiper support unit 92 which supports the wiper 91, and a movement mechanism 93 (refer to FIG. 2) which moves the wiper support unit 92. In addition, the wiping device 82 causes the wiper 91 to wipe the nozzle forming faces 23 of all of the liquid ejecting heads 21 by moving the wiper support unit 92 in a parallel arrangement direction of the liquid ejecting head 21. In this point, according to the embodiment, the wiping device 82 corresponds to an example of the "wiping unit".

Subsequently, an electrical configuration of the liquid ejecting apparatus 10 will be described with reference to FIG. 2.

Figure 2:
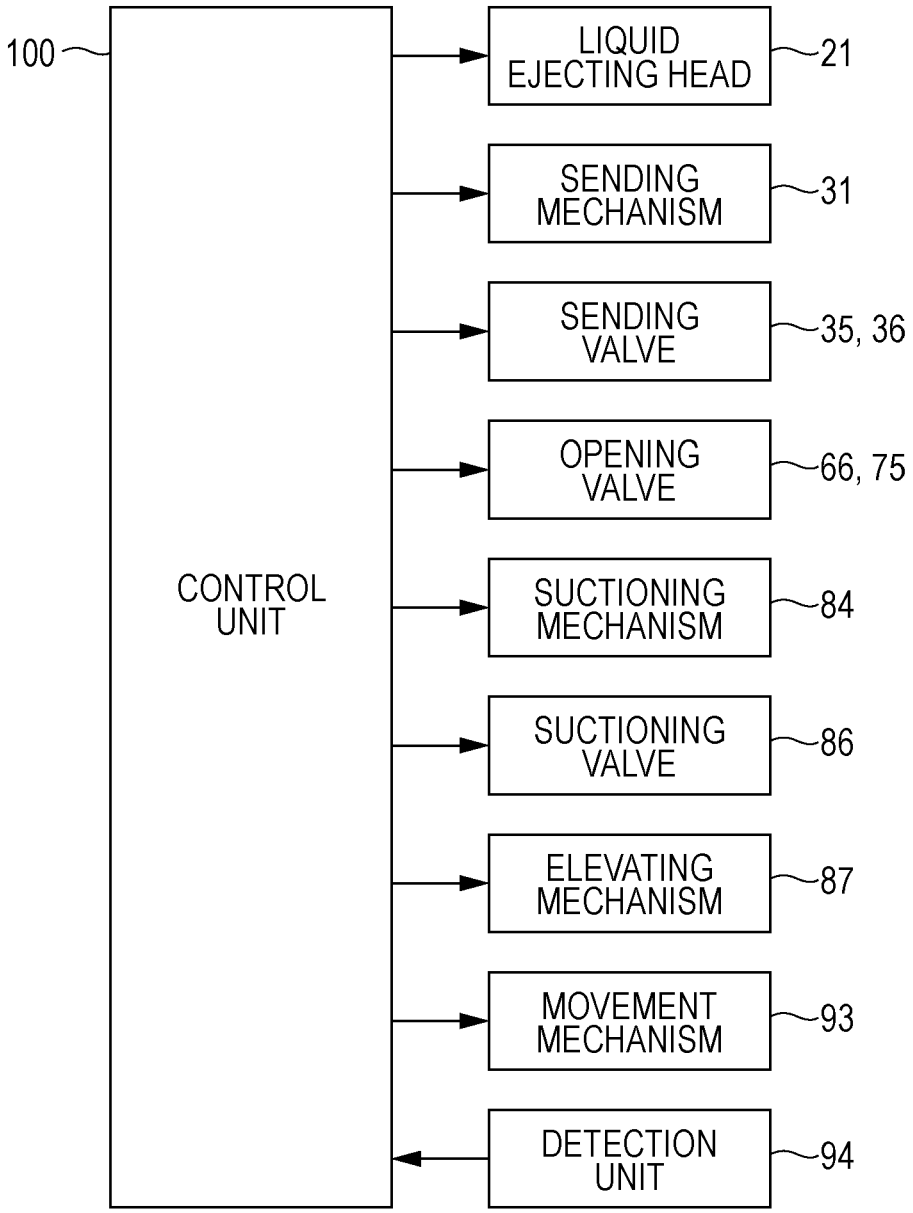
FIG. 2 is a block diagram which illustrates an electrical configuration of the liquid ejecting apparatus.

As illustrated in FIG. 2, the liquid ejecting apparatus 10 includes a control unit 100 which integrally controls the device. In addition, the liquid ejecting apparatus 10 includes a detection unit 94 which can detect a nozzle 22 in which an ejecting failure of liquid occurs (hereinafter, referred to as "defective nozzle"). In addition, the detection unit 94 is connected to an interface on the input side of the control unit 100, and the liquid ejecting head 21, the sending mechanism 31, the sending valves 35 and 36, the opening valves 66 and 75, the suctioning mechanism 84, the suctioning valve 86, the elevating mechanism 87, and a movement mechanism 93 are connected to an interface on the output side.

Here, in the liquid ejecting head 21 in which liquid is ejected from the nozzle 22 due to driving of a piezoelectric element, it is possible to cause the piezoelectric element to function as the detection unit 94. That is, when liquid is ejected from the nozzle 22 of the liquid ejecting head 21, the vibrating plate performs damped vibration until the subsequent driving voltage is applied to a piezoelectric element, after applying a driving voltage to the piezoelectric element.

Here, when bubbles are mixed into the nozzle 22, there is a tendency that a frequency of residual vibration of the vibrating plate becomes high compared to a case in which bubbles are not mixed into the same nozzle 22 (normal case). In addition, when liquid in the nozzle 22 is thickened, there is a tendency that a frequency of residual vibration of the vibrating plate becomes low compared to a case in which liquid is not thickened inside the nozzle 22 (normal case). In this manner, it is possible to detect a defective nozzle by detecting a frequency of residual vibration of the vibrating plate which is accompanied by driving of a piezoelectric element.

Subsequently, a process routine which is executed by the control unit 100 of the liquid ejecting apparatus 10, and operations which are accompanied by the process will be described with reference to the flowchart in FIG. 3, and FIGS. 4 to 5B.

Figure 3:
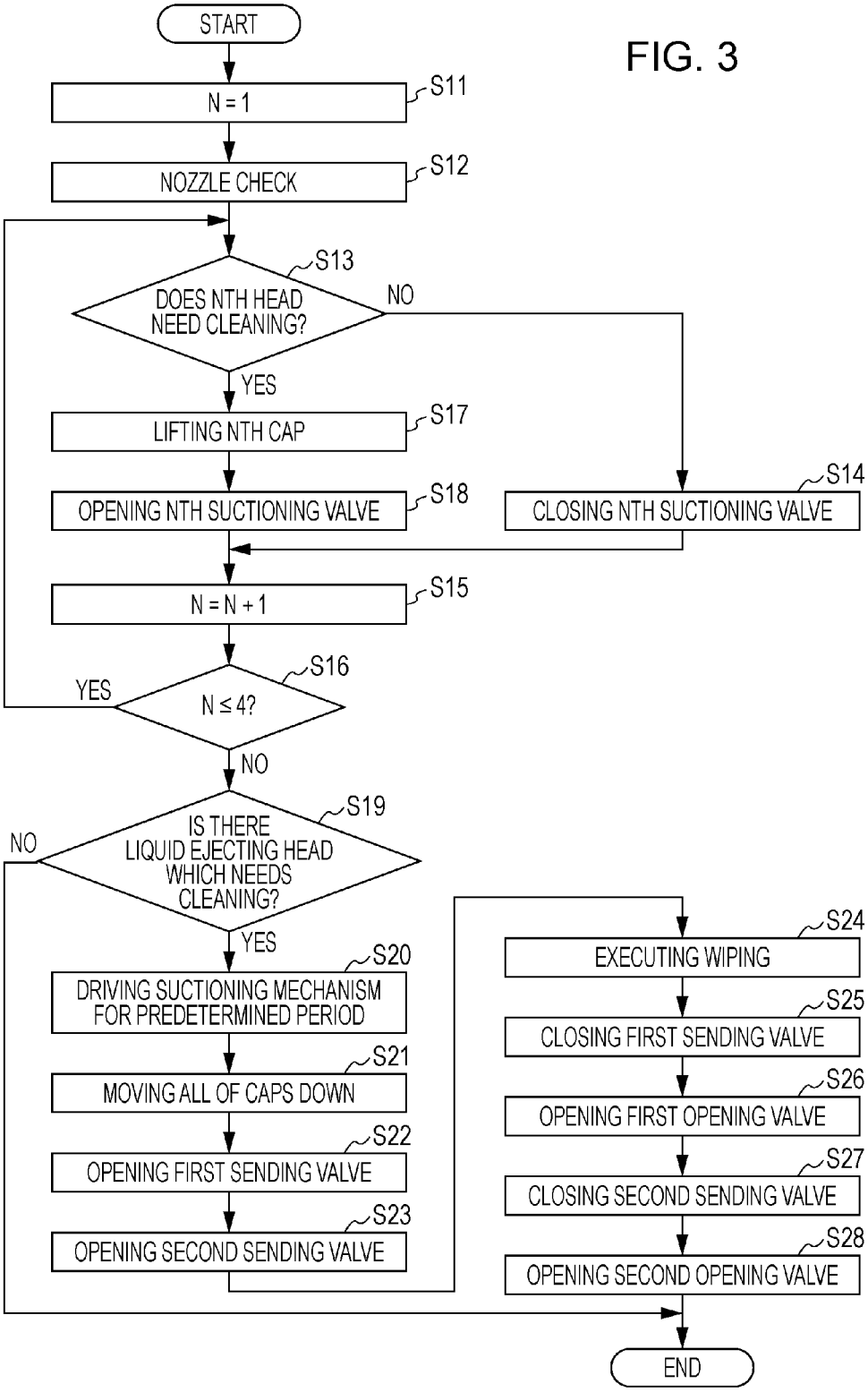
FIG. 3 is a flowchart which illustrates a process routine which is executed by a control unit of the liquid ejecting apparatus.

As illustrated in FIG. 3, the control unit 100 sets "1" to a variable N (step S11), and causes the detection unit 94 to perform a nozzle check with respect to all of nozzles 22 of the liquid ejecting unit 20 (step S12). Here, in the nozzle check, whether or not an ejecting failure of liquid due to mixing of bubbles or thickening of liquid has occurred in the nozzle 22 as the detection target is determined.

Subsequently, the control unit 100 determines whether or not cleaning is necessary with respect to the Nth head (step S13). Here, the liquid ejecting head 21 in which cleaning is necessary may be set to a liquid ejecting head 21 in which nozzles 22 of a predetermined rate (for example, "1%") or more are defective among all of the nozzles 22 which are formed in the liquid ejecting head 21. Otherwise, the liquid ejecting head 21 in which cleaning is necessary may be set to a liquid ejecting head 21 which includes defective nozzles of a predetermined number (for example, "1") or more. Here, the predetermined rate or the predetermined number can be arbitrarily set.

When cleaning of the Nth head is not necessary (No in step S13), the control unit 100 opens the Nth suctioning valve corresponding to the Nth head (step S14), and increases the variable N by "1" (step S15).

Subsequently, the control unit 100 determines whether or not the variable N is 4 (the number of liquid ejecting heads 21) or less (step S16), and when the variable N is 4 or less (Yes in step S16), the process returns to the previous step S13.

Figure 4:
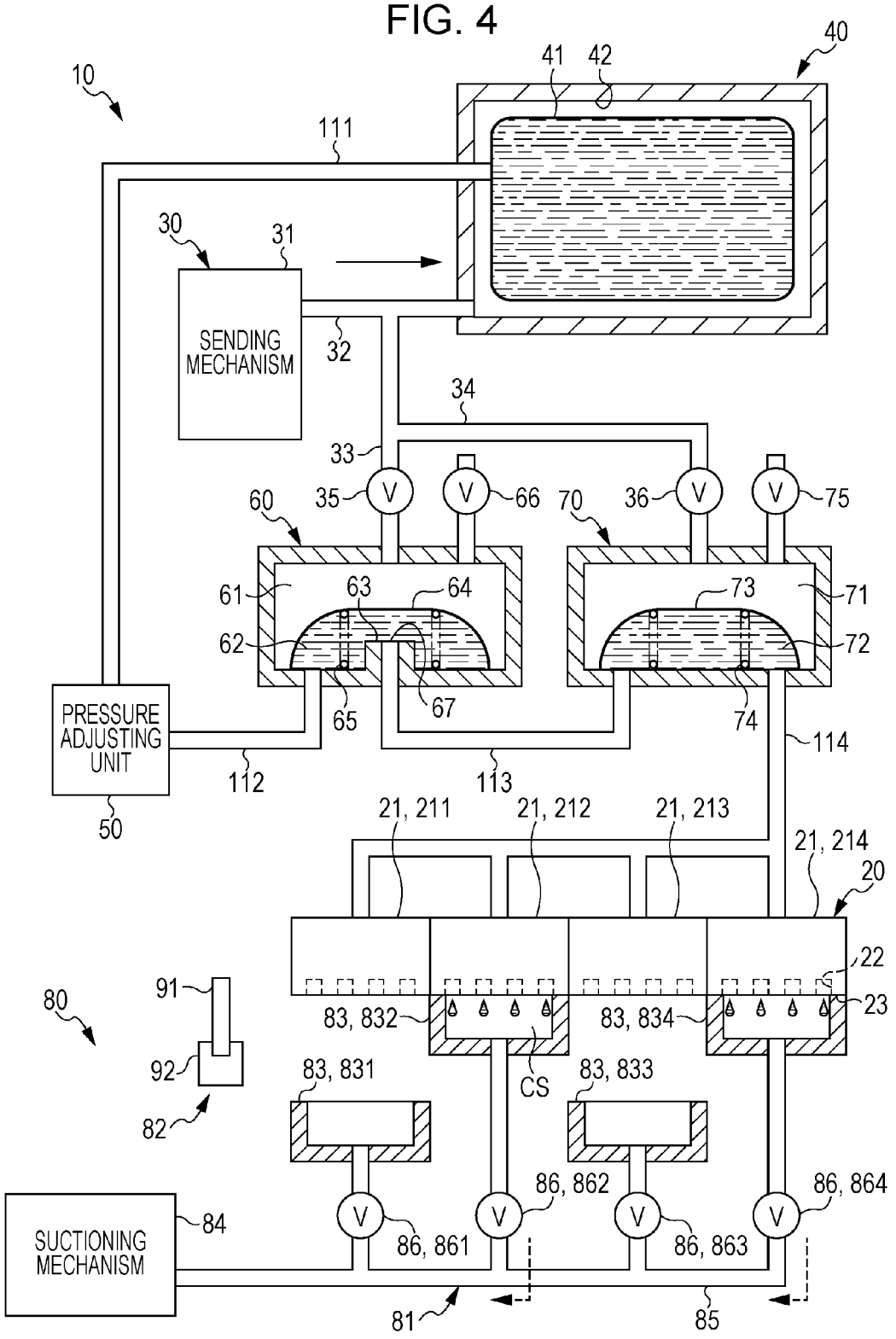
FIG. 4 is a diagram which illustrates a schematic configuration of the liquid ejecting apparatus when performing cleaning.

On the other hand, in the previous step S13, when cleaning of the Nth head is necessary (Yes in step S13), the control unit 100 lifts the Nth cap corresponding to the Nth head (step S17). Then, as illustrated in FIG. 4, a closed space CS including an opening of the nozzle 22 of the Nth head is formed.

In addition, the control unit 100 opens the Nth suctioning valve corresponding to the Nth head (step S18), and causes the closed space CS which is formed by executing the previous step and the suctioning mechanism 84 to communicate. Subsequently, the control unit 100 proceeds the process to the subsequent step S15.

In step S16, when the variable N is larger than 4 (No in step S16), the control unit 100 determines whether or not there is a liquid ejecting head 21 which needs cleaning (step S19). When there is not a liquid ejecting head 21 which needs cleaning at all (No in step S19), the control unit 100 temporarily ends the process.

On the other hand, when there is one or more liquid ejecting heads 21 which needs cleaning (Yes in step S19), the control unit 100 drives the suctioning mechanism 84 for a predetermined time (step S20). In this manner, selective cleaning is performed with respect to a liquid ejecting head 21 which includes a defective nozzle.

Then, the suctioning mechanism 84 suctions a fluid (air) in a closed space CS through the suctioning flow path 85, and the closed space CS is decompressed. In addition, the pressure adjusting unit 50 causes the first supply flow path 111 and the second supply flow path 112 to communicate when a pressure of the second supply flow path 112 which communicates with the nozzle 22 which opens to the closed space CS through the fourth supply flow path 114, the liquid chamber 72 of the liquid pressurizing unit 70, the third supply flow path 113, and the liquid chamber 62 of the supply regulation unit 60 becomes less than a predetermined pressure.

In this manner, liquid is continuously supplied from the liquid accommodation unit 40 to the liquid ejecting unit 20, and as illustrated in FIG. 4, liquid is discharged from a liquid ejecting head 21 which is a cleaning target. In this point, according to the embodiment, steps S13 to S20 correspond to an example of a "discharging process" for discharging liquid from nozzles 22 which are formed one or more liquid ejecting heads 21 among the plurality of liquid ejecting heads 21.

In addition, the liquid which is discharged from the liquid ejecting head 21 is discharged to the suctioning mechanism 84 through the suctioning flow path 85. In addition, it is preferable that a predetermined time is a period in which an ejecting failure of liquid in the nozzle 22 of the liquid ejecting head 21 which is a cleaning target can be fixed, and it is preferable to obtain the predetermined time in advance through an experiment, or the like.

In addition, when executing cleaning, it is assumed that a difference which is obtained by subtracting a pressure in a space to which a nozzle 22 is open (hereinafter, also referred to as "external pressure Po") from a pressure of liquid in the nozzle 22 (hereinafter, also referred to as "internal pressure Pi") of the liquid ejecting head 21 which is a cleaning target is set to a "pressure difference ΔP"). In addition, when executing cleaning, a space to which the nozzle 22 is open is the closed space CS.

Then, when executing cleaning, it can be said that the pressure difference ΔP occurs so that the internal pressure Pi of the nozzle 22 becomes higher than the external pressure Po, when the suctioning mechanism 84 suctions a fluid from the closed space CS, and the pressure (external pressure Po) of the closed space CS becomes low. In this point, according to the embodiment, the suctioning mechanism 84 corresponds to an example of the "pressure difference causing unit", and the pressure difference ΔP at the time of executing cleaning corresponds to the "first pressure difference". In addition, in the following descriptions, cleaning which is executed by suctioning liquid from the closed space CS is also referred to as "suctioning cleaning".

Subsequently, the control unit 100 moves all of the caps 83 down (step S21). Specifically, since the cap 83 corresponding to a liquid ejecting head 21 which is not a cleaning target is in a state of being descent already, the control unit 100 moves the cap 83 which is lifted in the previous step S17 down. In addition, descending of the cap 83 may be performed in a state in which a pressure of the closed space CS is a negative pressure after stopping driving of the suctioning mechanism 84, and may be performed in a state in which the pressure of the closed space CS becomes approximately the same as the atmospheric pressure.

In addition, the control unit 100 opens the first sending valve 35 in a state in which the first opening valve 66 is opened (step S22). Then, gas flows into the gas chamber 61 of the supply regulation unit 60 from the sending mechanism 31 through the second sending flow path 33, and a pressure of the gas chamber 61 becomes gradually high when a flow-in amount of the gas with respect to the gas chamber 61 increases.

Figure 5A:
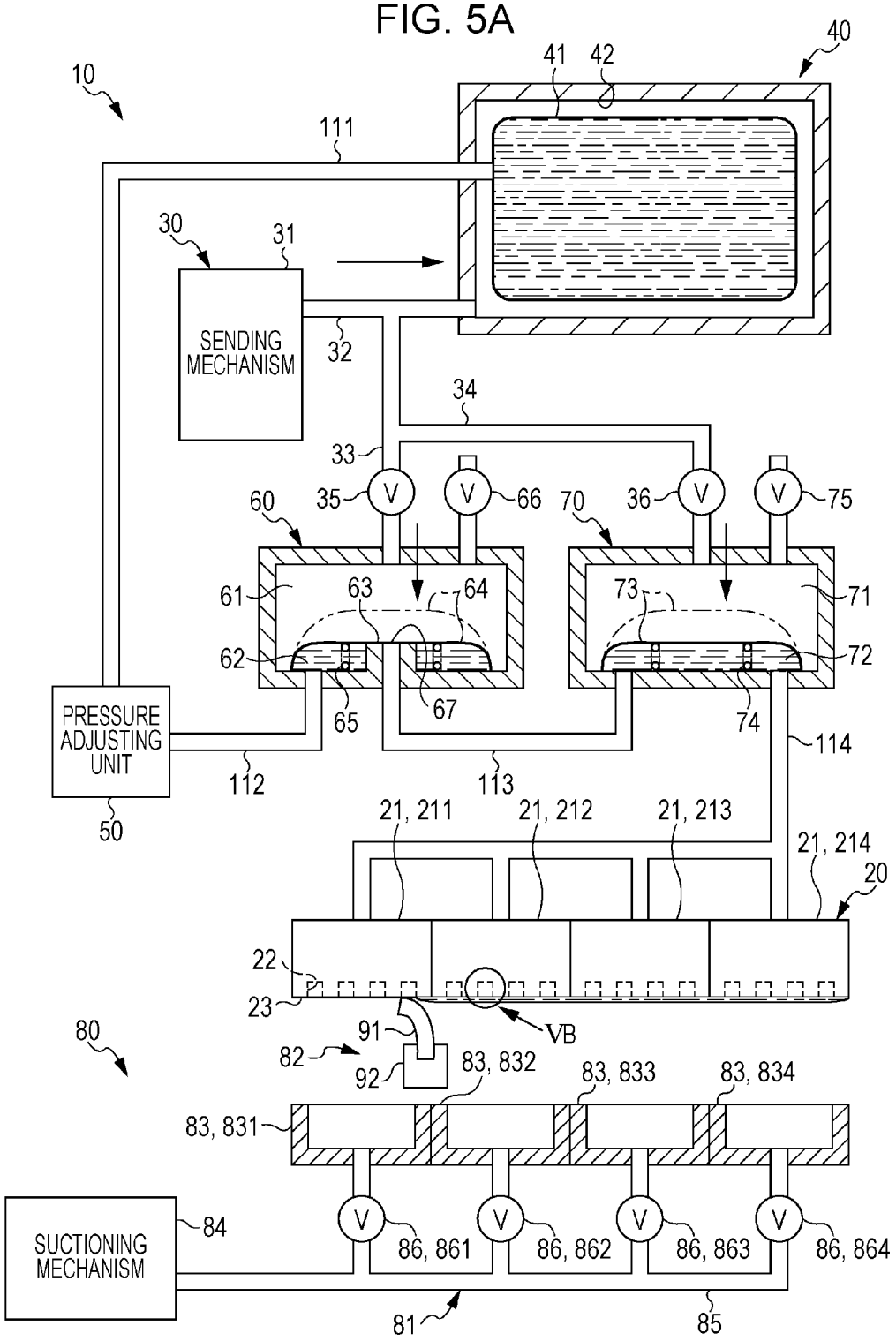

In addition, when the pressure of the gas chamber 61 becomes larger than that of the liquid chamber 62, the film member 64 is displaced in a direction in which a volume of the liquid chamber 62 is decreased (direction in which volume of gas chamber 61 is increased) against an urging force of the urging member 65, and the film member 64 closes the opening 67 of the protrusion unit 63 of the liquid chamber 62 (refer to FIG. 5A). As a result, the second supply flow path 112 and the third supply flow path 113 do not communicate, and the pressure adjusting unit 50 and the liquid pressurizing unit 70 do not communicate. In other words, a supply of liquid from the liquid accommodation unit 40 to the liquid ejecting unit 20 is regulated by the supply regulation unit 60.

Figure 5B:
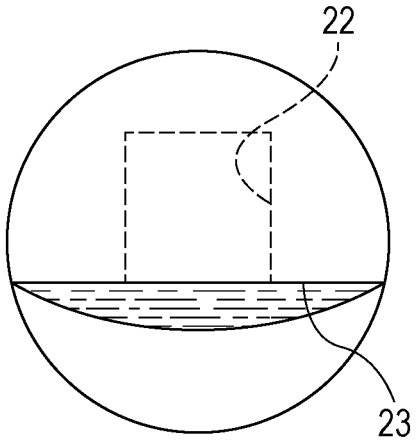

In addition, in the following descriptions, an arrangement of the film member 64 of the supply regulation unit 60 in FIGS. 5A and 5B is also referred to as a "regulating position", and a state of the supply regulation unit 60 when the film member 64 is located at the regulating position is also referred to as a "regulating state". As described above, when the supply regulation unit 60 is in the regulating state, a supply of liquid from the second supply flow path 112 to the third supply flow path 113 is regulated.

Subsequently, the control unit 100 opens the second sending valve 36 in a state in which the second opening valve 75 is opened (step S23). Then, gas flows into the gas chamber 71 of the liquid pressurizing unit 70 from the sending mechanism 31 through the third sending flow path 34, and a pressure of the gas chamber 71 becomes gradually high when a flow-in amount of the gas with respect to the gas chamber 71 increases.

In addition, when the pressure of the gas chamber 71 becomes larger than that of the liquid chamber 72, the film member 73 is displaced in a direction in which a volume of the liquid chamber 72 is decreased (direction in which volume of gas chamber 71 is increased) against an urging force of the urging member 74 (refer to FIG. 5A). Then, liquid in the liquid chamber 72 of the liquid pressurizing unit 70, in the third supply flow path 113 which communicates with the liquid chamber 72, in the fourth supply flow path 114, in the liquid ejecting head 21, and in the nozzle 22 are pressurized. In this point, according to the embodiment, the sending mechanism 31 corresponds to an example of a "volume changing unit" which can change the volume of the liquid chamber 72.

In addition, in the following descriptions, an arrangement of the film member 73 of the liquid pressurizing unit 70 in FIGS. 5A and 5B is also referred to as a "pressurizing position", and a state of the liquid pressurizing unit 70 when the film member 73 is located at the pressurizing position is also referred to as a "pressurizing state". As described above, the liquid pressurizing unit 70 in the pressurizing state pressurizes liquid in the liquid ejecting head 21, and in the nozzle 22.

In addition, in nozzles 22 of all of the liquid ejecting heads 21, liquid is leaked from the nozzles 22 of all of the liquid ejecting heads 21, by setting the internal pressure Pi to be higher than the external pressure Po. In this point, according to the embodiment, steps S22 and S23 correspond to an example of "leaking process" for leaking liquid from the nozzles 22 which are formed in the plurality of liquid ejecting heads 21.

In addition, it can be said that the pressure difference ΔP occurs so that a liquid pressure in the nozzle 22 (internal pressure Pi) becomes higher than the external pressure Po (which is atmospheric pressure) when the sending mechanism 31 decreases the volume of the liquid chamber 72 of the liquid pressurizing unit 70, and the liquid pressure (internal pressure Pi) in the nozzle 22 increases at the time of liquid being leaked from the nozzle 22. In this point, according to the embodiment, the sending mechanism 31 or the liquid pressurizing unit 70 also corresponds to an example of the "pressure difference causing unit", not only the suctioning mechanism 84, and the pressure difference ΔP when leaking liquid from the nozzle 22 corresponds to the "second pressure difference".

Here, the larger the pressure difference ΔP between the internal pressure Pi and the external pressure Po in the nozzle 22, the larger the amount of liquid which flows out from the nozzle 22 per unit time, and accordingly, it can be said that, when the pressure difference ΔP is set to the second pressure difference, the amount of liquid which flows out from the nozzle 22 per unit time becomes small compared to a case in which the pressure difference ΔP is set to the first pressure difference.

In addition, according to the embodiment, leaking of liquid from the nozzle 22 is a state in which a liquid face (hereinafter, also referred to as "meniscus") which is formed in a concave shape toward the inside of the nozzle 22 is broken, and liquid which outflows from the nozzle 22 spreads to the nozzle forming face 23, in the nozzle 22.

In addition, the control unit 100 drives the movement mechanism 93, and causes the mechanism to execute wiping in which the nozzle forming faces 23 of all of the liquid ejecting heads 21 are wiped using the wiper 91 (step S24). In this point, according to the embodiment, step S24 corresponds to an example of a "wiping process" for wiping the nozzle forming faces 23 of the plurality of liquid ejecting heads 21.

In addition, in step S24, as illustrated in FIGS. 5A and 5B, pressurizing wiping in which nozzle forming faces 23 of all of the liquid ejecting heads 21 are wiped using the wiper 91 is executed in a state in which liquid leaks from the nozzles 22 of all of the liquid ejecting heads 21, in other words, in a state in which the pressure difference ΔP becomes the second pressure difference.

Subsequently, the control unit 100 opens the first sending valve 35 (step S25), and opens the first opening valve 66 (step S26). Then, a pressure in the gas chamber 61 becomes low up to the atmospheric pressure when the gas chamber 61 of the supply regulation unit 60 is open to atmospheric air, in a state in which flow-in of gas from the sending mechanism 31 to the gas chamber 61 of the supply regulation unit 60 is regulated.

In this manner, the film member 64 is displaced in a direction in which a volume of the liquid chamber 62 is increased (direction in which volume of gas chamber 61 is decreased) due to a restoring force of the urging member 65, and the film member 64 opens the opening 67 of the protrusion unit 63 of the liquid chamber 62. As a result, the second supply flow path 112 and the third supply flow path 113 communicate, and the pressure adjusting unit 50 and the liquid pressurizing unit 70 communicate. In other words, a supply of liquid from the liquid accommodation unit 40 to the liquid ejecting unit 20 which is regulated by the supply regulation unit 60 is allowed. In addition, liquid which flows into the liquid chamber 62 is supplied from the second supply flow path 112 along with an increase in volume of the liquid chamber 62.

In addition, the control unit 100 opens the second sending valve 36 (step S27), and opens the second opening valve 75 (step S28). Then, a pressure in the gas chamber 71 becomes low up to the atmospheric pressure when the gas chamber 71 of the liquid pressurizing unit 70 is open to atmospheric air, in a state in which flow-in of gas from the sending mechanism 31 to the gas chamber 71 of the liquid pressurizing unit 70 is regulated.

In this manner, the film member 73 is displaced in a direction in which the volume of the liquid chamber 72 is increased (direction in which volume of gas chamber 71 is decreased) due to a restoring force of the urging member 74. Here, since liquid which flows into the liquid chamber 72 is in a state in which a supply of liquid from the second supply flow path 112 to the third supply flow path 113 is allowed due to executions of the previous steps S25 and S26 along with an increase in volume of the liquid chamber 72, the liquid is supplied from the third supply flow path 113. That is, supplying of the liquid from the fourth supply flow path 114 is suppressed. In addition, the control unit 100 temporarily stops the process.

Subsequently, operations of the liquid ejecting apparatus 10 will be described with reference to FIG. 1, and FIGS. 4 to 5B. In addition, in FIG. 1, and FIGS. 4 to 5B, a solid arrow denotes a flow of gas (air), and a dashed arrow denotes a flow of a fluid (air and liquid).

Meanwhile, in the liquid ejecting apparatus 10, when liquid is ejected onto the medium M, as illustrated using the solid arrow in FIG. 1, liquid which is accommodated in the liquid accommodation unit 40 is supplied in a pressurized manner to the downstream side when gas is sent from the sending mechanism 31 to the storage chamber 42. In addition, the liquid which is supplied from the liquid accommodation unit 40 is supplied to the liquid ejecting unit 20 after being adjusted to a pressure which is less than the atmospheric pressure in the pressure adjusting unit 50. In this manner, the liquid ejecting unit 20 ejects liquid of which the pressure is adjusted toward the medium M.

In addition, when the liquid ejecting apparatus 10 is continuously used, there is a case in which an ejecting failure of liquid occurs in a nozzle 22 of a part of the liquid ejecting heads 21. In such a case, according to the embodiment, selective cleaning is performed with respect to the liquid ejecting head 21 with a defective nozzle in which the ejecting failure occurs. In addition, in descriptions of the operation, for ease of descriptions, it is assumed that the second head 212, and the fourth head 214 are set to the cleaning target among the plurality of liquid ejecting heads 21.

As illustrated in FIG. 4, when performing cleaning, the second cap 832 and the fourth cap 834 corresponding to the second head 212 and the fourth head 214 as the cleaning target are lifted, and the closed spaces CS are formed with respect to the second head 212 and the fourth head 214. In addition, as illustrated in the dashed arrow in FIG. 4, liquid is discharged from the nozzles 22 of the second head 212 and the fourth head 214 when the suctioning mechanism 84 is driven in a state in which the second suctioning valve 862 and the fourth suctioning valve 864 are opened.

In addition, since liquid is attached to the nozzle forming faces 23 of the second head 212 and the fourth head 214 which are set to the cleaning target after executing cleaning, wiping is performed in order to remove the liquid. Here, according to the embodiment, wiping (pressurizing wiping) is performed in a state in which liquid is leaked from the nozzles 22 of all of the liquid ejecting heads 21.

As illustrated in FIG. 5A, when executing wiping, as denoted by the solid arrow, the film member 64 of the supply regulation unit 60 is displaced to the regulating position from the allowing position, and the supply regulation unit 60 is set to the regulating state from the allowing state by sending gas from the sending mechanism 31 to the gas chamber 61 of the supply regulation unit 60.

In addition, as denoted by the solid arrow, the film member 73 of the liquid pressurizing unit 70 is displaced to the pressurizing position from the non-pressurizing position by sending gas to the gas chamber 71 of the liquid pressurizing unit 70 from the sending mechanism 31, and the liquid pressurizing unit 70 is set to the pressurizing state from the non-pressurizing state. That is, as illustrated in FIG. 5B, it enters a state in which liquid is leaked from the nozzles 22 of all of the liquid ejecting heads 21. In this manner, the nozzle forming faces 23 of all of the liquid ejecting heads 21 are wiped using the wiper 91 in a state in which liquid is leaked from the nozzles 22 of all of the liquid ejecting heads 21.

Here, as illustrated in FIGS. 5A and 5B, a pressure of liquid in the nozzles 22 (internal pressure Pi) of all of the liquid ejecting heads 21 becomes higher than a pressure of external gas (external pressure Po (=atmospheric pressure)) of the nozzles 22. For this reason, when performing wiping, it is difficult for the wiper 91 to push bubbles into the nozzle 22, and mixing of bubbles into the nozzle 22 is suppressed. In addition, according to the embodiment, since wiping is performed in a state in which liquid is leaked, a slide resistance when the wiper 91 wipes the nozzle forming face 23 is reduced, and a load with respect to the wiper 91 is reduced.

In addition, the pressure difference ΔP (=second pressure difference) of the nozzle 22 of the liquid ejecting head 21 when executing pressurizing wiping is set to be smaller than the pressure difference ΔP (=first pressure difference) in the nozzle 22 of the liquid ejecting head 21 when executing cleaning (discharging process). For this reason, when executing the pressurizing wiping, quantity of flow of liquid which flows out from the nozzle 22 per unit time becomes small compared to that when executing cleaning, and it is possible to suppress excessive leaking of liquid from the liquid ejecting unit 20 by executing the pressurizing wiping.

According to the above described embodiment, it is possible to obtain the following effects.

(1) Wiping of the nozzle forming faces 23 of all of the liquid ejecting heads 21 is performed in a state in which liquid is leaked from all of the liquid ejecting heads 21, after executing cleaning in which liquid is discharged from a part of the liquid ejecting heads 21. Here, when executing wiping, since a pressure of liquid in nozzles 22 (internal pressure Pi) which are included in the plurality of liquid ejecting heads 21 is higher than a pressure of a space (external pressure Po) to which the nozzle 22 is open, it is possible to prevent the wiping unit from pushing bubbles into the nozzle 22.

In this manner, it is possible to suppress mixing of bubbles into the nozzles 22 which are included in the plurality of liquid ejecting heads 21 when wiping the nozzle forming faces 23 formed in the plurality of liquid ejecting heads 21 after discharging liquid from the nozzles 22 which are included in a part of the liquid ejecting heads 21 among the plurality of liquid ejecting heads 21.

(2) On the other hand, a pressure difference ΔP (internal pressure Pi-external pressure Po) in the nozzle 22 which is included in the liquid ejecting head 21 which executes pressurizing wiping (leaking process) is set to be smaller than a pressure difference ΔP (internal pressure Pi-external pressure Po) in the nozzle 22 which is included in a part of the liquid ejecting heads 21 which executes cleaning (discharging process). For this reason, it is possible to suppress excessive leaking of liquid from the liquid ejecting unit 20 by executing pressurizing wiping (leaking process).

(3) Since it is set such that a closed space CS which includes an opening of a nozzle 22 can be formed in each liquid ejecting head 21 using the cap 83, it is possible to form the closed space CS using the cap 83 with respect to a liquid ejecting head 21 as a cleaning target. Accordingly, it is possible to prevent liquid which is discharged from the liquid ejecting head 21 as the cleaning target from coming into a nozzle 22 included in a liquid ejecting head 21 which is not a cleaning target through the nozzle forming face 23, or the like. In particular, when a closed space CS is formed using the cap 83 in the liquid ejecting head 21 as the cleaning target, it is possible to suppress scattering of liquid which is discharged from a nozzle 22 when performing cleaning.

(4) A closed space CS including an opening of a nozzle 22 of a liquid ejecting head 21 is formed, and suctioning cleaning in which liquid is discharged from a liquid ejecting head 21 by compressing the closed space CS is performed. In addition, according to the suctioning cleaning, it is possible to easily discharge liquid from one or more liquid ejecting heads 21 selected from the plurality of liquid ejecting heads 21, regardless of a supply form of liquid with respect to the plurality of liquid ejecting heads 21 compared to cleaning which is performed by pressurizing liquid (hereinafter, referred to as "pressurizing cleaning") in a nozzle 22 of a liquid ejecting head 21.

(5) It is possible to raise a pressure (internal pressure Pi) of liquid in a nozzle 22 of a liquid ejecting unit 20 which communicates with a liquid chamber 72 through a supply flow path by reducing a volume of the liquid chamber 72 using flowing of gas into a gas chamber 71 of a liquid pressurizing unit 70, by providing the liquid pressurizing unit 70 in the middle of supply flow paths 111 to 114 which supply liquid to the liquid ejecting unit 20 from the liquid accommodation unit 40. In addition, it is possible to leak liquid from the nozzles 22 which are included in the plurality of liquid ejecting heads 21 by generating a pressure difference ΔP between the internal pressure Pi and the external pressure Po, by raising the internal pressure Pi.

(6) Since the detection unit 94 which can detect a defective nozzle in which an ejecting failure of liquid occurs is included, and cleaning is executed with respect to a liquid ejecting head 21 which includes the defective nozzle, it is possible to perform selective maintenance with respect to the liquid ejecting head 21 which includes the nozzle 22 in which the ejecting failure of liquid occurs. Accordingly, it is possible to suppress maintenance of a liquid ejecting head 21 which does not include a nozzle 22 in which the ejecting failure of liquid occurs, and to suppress an increase in the amount of liquid consumption which is associated with unnecessary maintenance.

(7) Wiping is executed in a state in which a pressure of liquid in a nozzle 22 (internal pressure Pi) is set to be higher than a pressure of gas out of a nozzle 22 (external pressure Po) so as to leak liquid from the nozzle 22. For this reason, since wiping of a nozzle forming face 23 can be executed in a state in which liquid is attached all over the nozzle forming face 23, it is possible to prevent a dried nozzle forming face 23 from being wiped using a dried wiper 91. For this reason, it is possible to reduce a slide resistance which acts on a wiper 91 when the wiper 91 wipes a nozzle forming face 23.

In addition, in the above described embodiment, the following changes may be performed.

According to the embodiment, liquid is discharged from a nozzle 22 of a liquid ejecting head 21 using the cleaning device 81, and on the other hand, liquid is caused to leak from a nozzle 22 of a liquid ejecting head 21 using the liquid pressurizing unit 70; however, it may be different. For example, an internal pressure Pi of a nozzle 22 may be raised when the sending mechanism 31 sends gas to the storage chamber 42, and supplies liquid which is accommodated in the liquid accommodation unit 40 in a pressurized manner toward the liquid ejecting unit 20. In addition, any of pressurizing cleaning (discharging process) and pressurizing wiping (leaking process) may be performed by raising the internal pressure Pi of the nozzle 22.

Here, in the discharging process and the leaking process, it is preferable to set a pressure difference ΔP in the discharging process to be higher than a pressure difference ΔP in the leaking process by providing a difference in a sending form of gas using the sending mechanism 31. In addition, in this case, it is preferable to set a state in which the pressure adjusting unit 50 causes the first supply flow path 111 and the second supply flow path 112 to communicate, without depending on a pressure in the second supply flow path 112.

In this manner, it is possible to perform cleaning and pressurizing wiping by causing a pressure difference ΔP between an internal pressure Pi and an external pressure Po in a nozzle 22, by raising a pressure of liquid which is supplied to the liquid ejecting unit 20. For this reason, as in the embodiment, when a configuration for supplying liquid which is accommodated in the liquid accommodation unit 40 to the liquid ejecting unit 20 in a pressurized manner (sending mechanism 31) is provided, it is possible to easily perform cleaning and pressurizing wiping. In addition, in this case, the supply regulation unit 60 may not be provided.

The liquid ejecting unit 20 may be a liquid ejecting unit 20 which includes a single liquid ejecting head 21 in which a plurality of nozzle groups (for example, nozzle column) are formed. In this case, it is preferable that the cleaning device 81 forms a closed space CS in each nozzle group, and cleaning can be executed in each nozzle group. In addition, wiping of a nozzle forming face 23 of a liquid ejecting head 21 may be executed in a state in which liquid is leaked from all of nozzle 22 columns, after executing cleaning with respect to a part of nozzle groups.

The cleaning device 81 may include a single cap 83. In this case, it is preferable that a partition is included in the cap 83 so that the cap 83 can form a closed space CS which includes an opening of a nozzle 22 in each liquid ejecting head 21 or in each nozzle group by coming into contact with the nozzle forming face 23.

The cleaning device 81 may include only the first cap 831. In this case, it is preferable that the first cap 831 can move in a parallel arrangement direction of a plurality of liquid ejecting heads 21, and a closed space CS which includes an opening of a nozzle 22 of a selected liquid ejecting head 21 can be formed.

The cleaning device 81 may not include a plurality of suctioning valves 86 by corresponding to a plurality of liquid ejecting heads 21. In this case, it is preferable that the cleaning device 81 includes a plurality of suctioning mechanisms 84 which communicate with a plurality of caps 83, and individual cleaning can be performed with respect to the plurality of liquid ejecting heads 21 by individually controlling driving of the plurality of suctioning mechanisms 84.

The detection unit 94 may be an imaging unit (camera) which images an ejecting form of liquid from all of the nozzles 22. In addition, the detection unit may determine whether or not it is a defective nozzle by analyzing an imaged image.

A cam member, and a driving motor which rotates the cam member may be included in the supply regulation unit 60 and the liquid pressurizing unit 70, and volumes of the liquid chambers 62 and 72 may be increased by setting the film members 64 and 73 to a pressing state or a non-pressing state according to a rotation of the cam member.

The supply regulation unit 60 may be a general opening valve (two-way valve) which can be open or closed according to an electrical signal.

The liquid pressurizing unit 70 may have a configuration in which liquid in the inside of a liquid ejecting head 21 is pressurized by squashing the fourth supply flow path 114, for example.

In leaking of liquid from a nozzle 22 in a leaking process, dropping of liquid from the nozzle 22 is included.

In pressurizing cleaning, a closed space CS may be formed by lifting a cap 83 corresponding to a liquid ejecting head 21 which executes cleaning, and the closed space CS may be formed by lifting a cap 83 corresponding to a liquid ejecting head 21 which does not execute cleaning.

After cleaning, wiping of a nozzle forming face 23 of a liquid ejecting head 21 in which cleaning is performed may be executed, and on the other hand, wiping of a nozzle forming face 23 of a liquid ejecting head 21 in which cleaning is not performed may not be executed. For example, selective wiping may be executed with respect to only a nozzle forming face 23 of a liquid ejecting head 21 in which cleaning is executed, by setting the wiping device 82 to go up and down.

The liquid ejecting apparatus 10 may be a serial printer in which the liquid ejecting unit 20 ejects ink while reciprocating in a width direction of a medium M, and may be a line printer in which the liquid ejecting unit 20 ejects ink in a state of being arranged in a fixed manner with a length corresponding to the entire width of the medium M.

Liquid which is ejected by the liquid ejecting unit 20 is not limited to ink, and may be a liquid body, or the like, which is obtained by dispersing or mixing particles of a functional material into liquid, for example. For example, it may be a configuration in which recording is performed by ejecting a liquid body including a material such as an electrode material which is used when manufacturing, for example, a liquid crystal display, an electroluminescence (EL) display, and a surface light emission display, or a coloring material (pixel material) in a form of dispersing or melting.

The medium M is not limited to a sheet, may be a plastic film, a thin plate, or the like, and may be cloth which is used in a textile printing apparatus, or the like.

The entire disclosure of Japanese Patent Application No. 2014-241804, filed Nov. 28, 2014 is expressly incorporated by reference herein.

What is claimed is:

1. A liquid ejecting apparatus comprising:

a liquid ejecting unit which includes a nozzle forming face on which a plurality of nozzle groups for ejecting liquid are formed;

a pressure difference causing unit which causes a pressure difference so that an internal pressure is higher than an external pressure in nozzles included in one or more nozzle groups among the plurality of nozzle groups, when a difference which is obtained by subtracting the external pressure which is a pressure in a space to which a nozzle is open from the internal pressure which is a pressure of liquid in the nozzle included in the nozzle groups is set to the pressure difference; and a wiping unit which wipes the nozzle forming face, wherein a wiping process for wiping the nozzle forming face is performed while a leaking process for leaking liquid from the plurality of nozzle groups is performed by setting the pressure difference to a second pressure difference which is smaller than a first pressure difference, after performing a discharging process for discharging liquid from a part of nozzle groups among the plurality of nozzle groups by setting the pressure difference to the first pressure difference.

2. The liquid ejecting apparatus according to claim 1, further comprising:

a cap which forms a closed space which includes an opening of the nozzle in each of the nozzle groups by coming into contact with the nozzle forming face.

3. The liquid ejecting apparatus according to claim 2, wherein the pressure difference causing unit includes a suctioning mechanism which suctions liquid from the closed space, and wherein the discharging process is performed when the suctioning mechanism suctions liquid from the closed space, and lowers the external pressure.

4. The liquid ejecting apparatus according to claim 1, further comprising:

a supply flow path through which liquid accommodated in a liquid accommodation unit is supplied to the liquid ejecting unit, wherein the pressure difference causing unit includes a liquid chamber which is provided in the middle of the supply flow path, and a volume changing unit which changes a volume of the liquid chamber, and wherein the volume changing unit makes the volume of the liquid chamber small, and the leaking process is performed by raising the internal pressure.

5. The liquid ejecting apparatus according to claim 1, wherein the pressure difference causing unit includes a pressurizing supply unit which supplies liquid to the liquid ejecting unit in a pressurized manner, and wherein the pressurizing supply unit supplies liquid in the pressurized manner, and at least one of the discharging process and the leaking process is performed by raising the internal pressure.

6. The liquid ejecting apparatus according to claim 1, further comprising:

a detection unit which can detect a defective nozzle in which an ejecting failure of liquid occurs, wherein the discharging process is performed with respect to the nozzle group which includes the defective nozzle which is detected by the detection unit.

* * * * *